US005343007A

United States Patent [19]

Roeser et al.

[11] Patent Number: 5,343,007

[45] Date of Patent: Aug. 30, 1994

[54] ROCKER SWITCH

[75] Inventors: Thomas Roeser, Barrington; Michael J. Crawford, Crystal Lake, both of Ill.

[73] Assignee: Otto Engineering, Inc., Carpentersville, Ill.

[21] Appl. No.: 80,063

[22] Filed: Jun. 18, 1993

Related U.S. Application Data

[63] Continuation of Ser. No. 881,788, May 12, 1992, abandoned.

[51] Int. Cl.[5] ..... H01H 21/08

[52] U.S. Cl. ..... 200/296; 200/559; 200/302.3

[58] Field of Search ..... 200/559, 302.3, 296, 200/295

[56] References Cited

U.S. PATENT DOCUMENTS

| | | | |
|---|---|---|---|
| 2,027,538 | 1/1936 | Krieger . | |
| 2,377,134 | 5/1945 | Dietrich . | |
| 2,726,105 | 12/1955 | Koenig . | |
| 2,795,667 | 6/1957 | Schwerke . | |
| 3,294,932 | 12/1966 | Barlow . | |
| 3,299,224 | 1/1967 | DeLorme et al. . | |
| 3,350,521 | 10/1967 | Brown . | |
| 3,413,430 | 11/1968 | Sharples . | |
| 3,501,607 | 3/1970 | Tanaka . | |
| 3,571,545 | 3/1971 | Haderer . | |
| 3,581,033 | 5/1971 | Plumb . | |
| 3,585,335 | 6/1971 | Bulgarelli et al. . | |
| 3,591,747 | 7/1971 | Dennison . | |
| 3,688,062 | 8/1972 | Yamamoto et al. . | |
| 3,852,557 | 12/1974 | Brown . | |
| 4,789,766 | 12/1988 | Krause . | |
| 4,929,808 | 5/1990 | Roeser et al. . | |
| 4,937,407 | 6/1990 | Osika . | |
| 4,947,010 | 8/1990 | Heydner et al. | 200/296 |
| 4,982,061 | 1/1991 | Dignal . | |
| 5,105,059 | 4/1992 | Sorenson et al. | 200/302.3 |
| 5,158,172 | 10/1992 | Roeser et al. . | |

FOREIGN PATENT DOCUMENTS

| | | |
|---|---|---|
| 1014786 | 3/1950 | France . |
| 314162 | 10/1934 | Italy . |

OTHER PUBLICATIONS

Carlingswitch 610/620 Series Switch specification sheet.

Carlingswitch T Series Switch specification sheet.

*Primary Examiner*—Renee S. Luebke

*Attorney, Agent, or Firm*—McAndrews, Held & Malloy, Ltd.

[57] ABSTRACT

A sealed rocker switch includes a button having a lever. A coil spring coaxial with the lever and enclosing a portion of the lever forces a plunger against an actuator that rocks to place a spring blade in contact with blade contacts to operate the switch. The blade contacts are snapped into the case of the switch to maintain the blade contacts in a desired position, and are potted with a potting compound to make a seal. The actuator may be shaped in one of several ways to provide maintained contact, momentary contact, or a combination of these. A groove in the lever supports an O-ring against the case to seal the switch at the button end.

23 Claims, 8 Drawing Sheets

Fig. 12
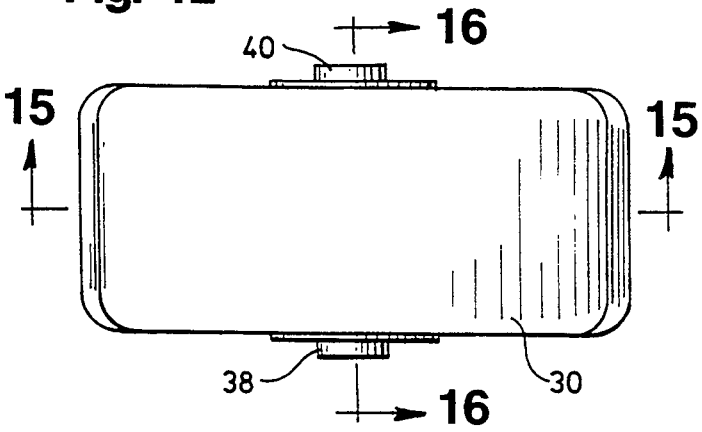
Fig. 14
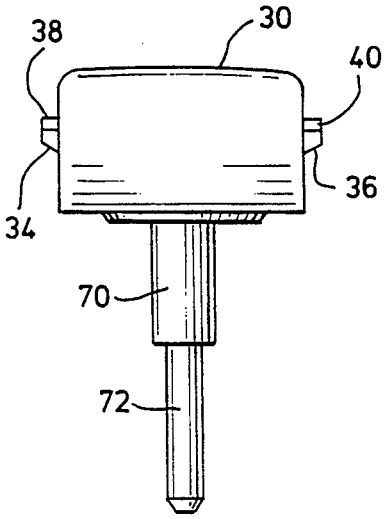
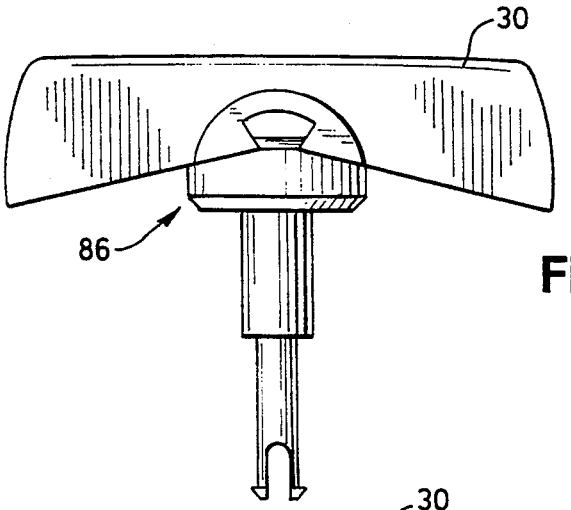
Fig. 13
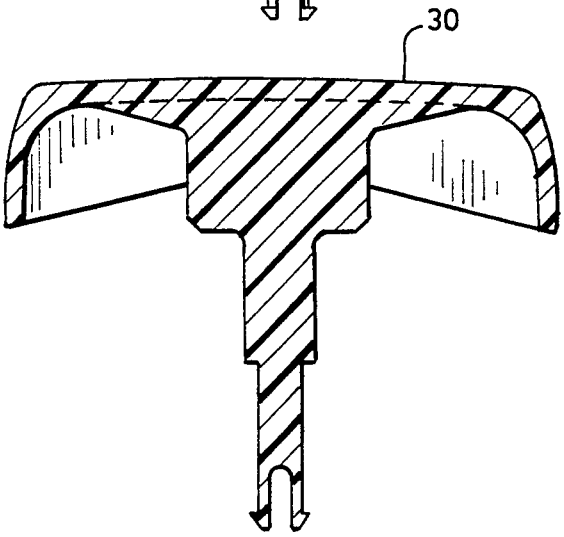
Fig. 15
Fig. 16
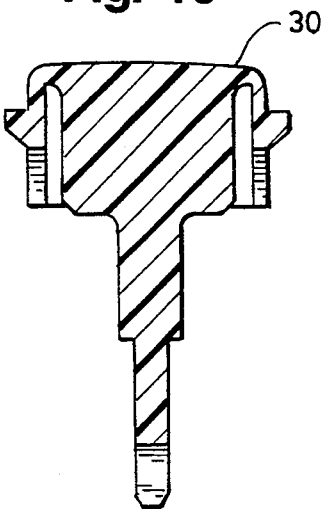

Fig. 19
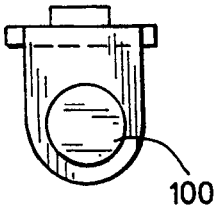
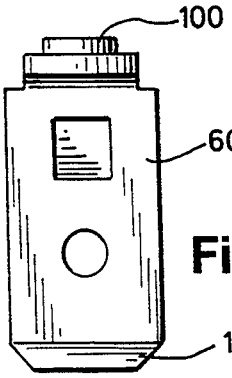
Fig. 17
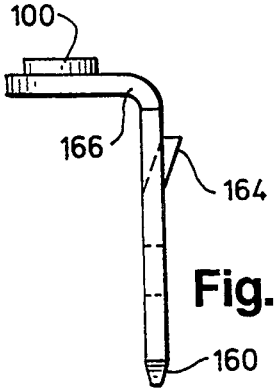
Fig. 18
Fig. 20
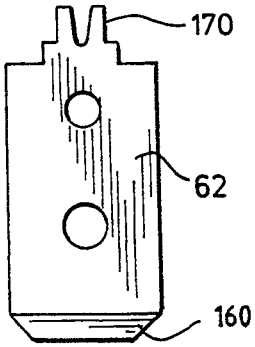
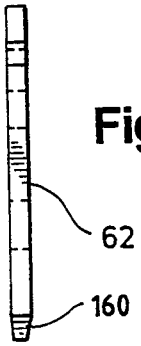
Fig. 21
Fig. 23
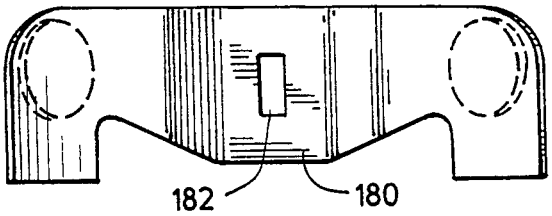
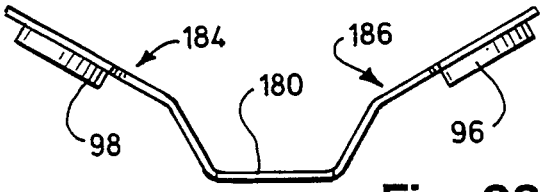
Fig. 22

ROCKER SWITCH

This is a continuation of application Ser. No. 07,881,788, filed May 12, 1992, now abandoned.

BACKGROUND OF THE INVENTION

This invention is related to electrical rocker switches. In particular, it is an improved rocker switch that is sealed against contamination by elements in the environment to provide a better and more reliable switch.

A rocker switch is a device having a plurality of terminals and means operated by a rocker for making and breaking electrical connections between pairs of those terminals. A rocker switch typically has two or more stable states, but the term is also applied to switches designed for manual operation by means of a rocker and having at least one stable state, with other states involving momentary operation. The possible operating combinations for a single pole-double throw (SPDT) rocker switch are maintain-maintain, maintain-momentary, momentary-maintain-momentary, maintain-maintain-maintain, and maintain-maintain-momentary. In these combinations the term maintain means a state in which a switch remains where it is placed and the term momentary means a state in which the switch remains only as long as it is held there. It is often desirable in making a switch to be able to achieve any or all of these combinations with minimum changes in manufacture.

A rocker switch includes a button that is mounted to a case to pivot about an axis or the like. A spring is typically placed in contact with the button to exert a biasing force that will maintain the button in one or more of the stable positions, and will also maintain or assist in maintaining a force on electrical contacts that are being switched into contact. When the spring is used to exert a force on a plunger that operates an actuator, the spring also supplies the force that causes the switch to toggle from one stable position to another, to move from a momentary position when an operator lets go, and to apply force to maintain electrical contact.

The principles of operation of a rocker switch such as the one of the present invention are illustrated in U.S. Pat. No. 5,158,172, entitled "Toggle Switch," which is assigned to the assignee of the present invention and which is incorporated here by reference as if set forth fully. Such a switch, like the one of the present invention, is made with either a single pole or a double pole. Either of these types may be built as a single-throw or double-throw switch. Whatever the type, single pole-single throw (SPST), single pole-double throw (SPDT), double pole-single throw (DPST), or double pole-double throw (DPDT), an actuator moves a blade to make and break electrical contacts. The shape of the actuator determines whether the switch maintains a position in which it is placed or whether it changes from that position.

The typical rocker switch is a commodity, made in relatively large numbers for industries such as boats, construction vehicles, and the like. This makes it important in designing a rocker switch to have a minimum number of parts and maximum ease of assembly as well as a permanent seal at the button and behind the panel.

Rocker switches are often specified to mount in relatively standard rectangular panel cutouts that range in length from 1.072" to 1,125" and in width from 0.490" to 0.550". To cover all standard cutouts, a rocker switch must fit into the smallest standard panel cutout and cover the largest. There are many available rocker switches that fit this description, but few or none of them are also sealed against water and dust.

It is often useful to have a light bulb in a rocker switch to indicate that the switch is on or to provide a visual indication of other information. Such a bulb is attached to the housing or other part of the switch and is allowed to shine through a transparent or translucent portion of the button that may be colored. In a two-terminal switch, the bulb must be powered from the switched terminals. In a three-terminal switch, the bulb may be powered from the switched terminals or it may be powered from an independent terminal. With four terminals, an SPDT switch can have independent control of power to the bulb, and with five or six terminals, a DPDT switch can have independent control of power to the bulb. Thus, it may be desirable to have as many as six terminals on a rocker switch. If these are blade terminals, they may be difficult to fit into a normal terminal configuration.

A number of rocker switches that are available are sealed by O-rings and the like at the rocker and are sealed at the area of insertion into the panel. All or almost all of these, however, are not sealed behind the panel. A switch that is sealed completely is protected against dust and water and may even be qualified as an explosion-proof or submersible switch.

SUMMARY OF THE INVENTION

It is an object of the present invention to provide a sealed electrical rocker switch.

It is a further object of the present invention to provide a reliable miniature or subminiature electrical rocker switch that fits standard panel cutouts.

It is a further object of the present invention to provide a rocker switch that is easier to manufacture than rocker switches that are presently known.

It is a further object of the present invention to provide a miniature or subminiature electrical rocker switch that can be manufactured to function in one of a plurality of maintain or momentary combinations by changing a single part during manufacture.

It is a further object of the present invention to provide a miniature or subminiature electrical rocker switch in which a lever is caused to pivot in its housing on a spherical portion of the housing.

It is a further object of the present invention to provide a miniature or subminiature electrical rocker switch in which forces tending to restore the switch to a maintained position from a momentary position and also to apply contact pressure are obtained from a single coil spring that encloses a lever that is part of the rocker and that engages a plunger.

Other objects will become apparent in the course of a detailed description of the invention.

A rocker switch includes a lever connected to a button that snaps into a pivoting engagement with the case of the switch. A spherical portion of the lever is held against a partially spherical surface in the housing, and an O-ring maintains a seal against dust and moisture. A coil spring coaxial with the lever and enclosing a portion of the lever forces a plunger against an actuator that rocks to place a spring blade in contact with a terminal to operate the switch. The plunger is constrained by the lever and actuator planar motion, which causes the lever to rotate substantially in a plane. Blade contacts extend through the base so as to keep them in a desired position, and the blade contacts are sealed against water and dust outside the switch by application of a potting compound. The actuator may be shaped in one of several ways to provide maintained contact, momentary contact, or a combination of these, and only the actuator need be changed to change the type of contact.

BRIEF DESCRIPTION OF THE DRAWINGS

FIG. 12 is a top view of the button of FIBS. 1*a* and 1*b*.

FIG. 13 is a side view of the button of FIGS. 1*a* and 1*b*.

FIG. 14 is an end view of the button of FIGS. 1*a* and 1*b*.

FIG. 15 is a central sectional side view of the button of FIGS. 1*a* and 1*b*.

FIG. 16 is a central sectional end view of the button of FIGS. 1*a* and 1*b*.

FIG. 17 is a side view of one of the first and second blade contacts of FIGS. 1*a* and 1*b*.

FIG. 18 is an end view of the blade contact of FIG. 17.

FIG. 19 is a top view of the blade contact of FIG. 17.

FIG. 20 is a side view of the center blade contact of FIGS. 1*a* and 1*b*.

FIG. 21 is an end view of the center blade contact of FIGS. 1*a* and 1*b*.

FIG. 22 is a side view of the center blade contact of FIGS. 1*a* and 1*b*.

FIG. 23 is a top view of the center blade contact of FIGS. 1*a* and 1*b*.

DETAILED DESCRIPTION OF THE INVENTION

Figure 1:
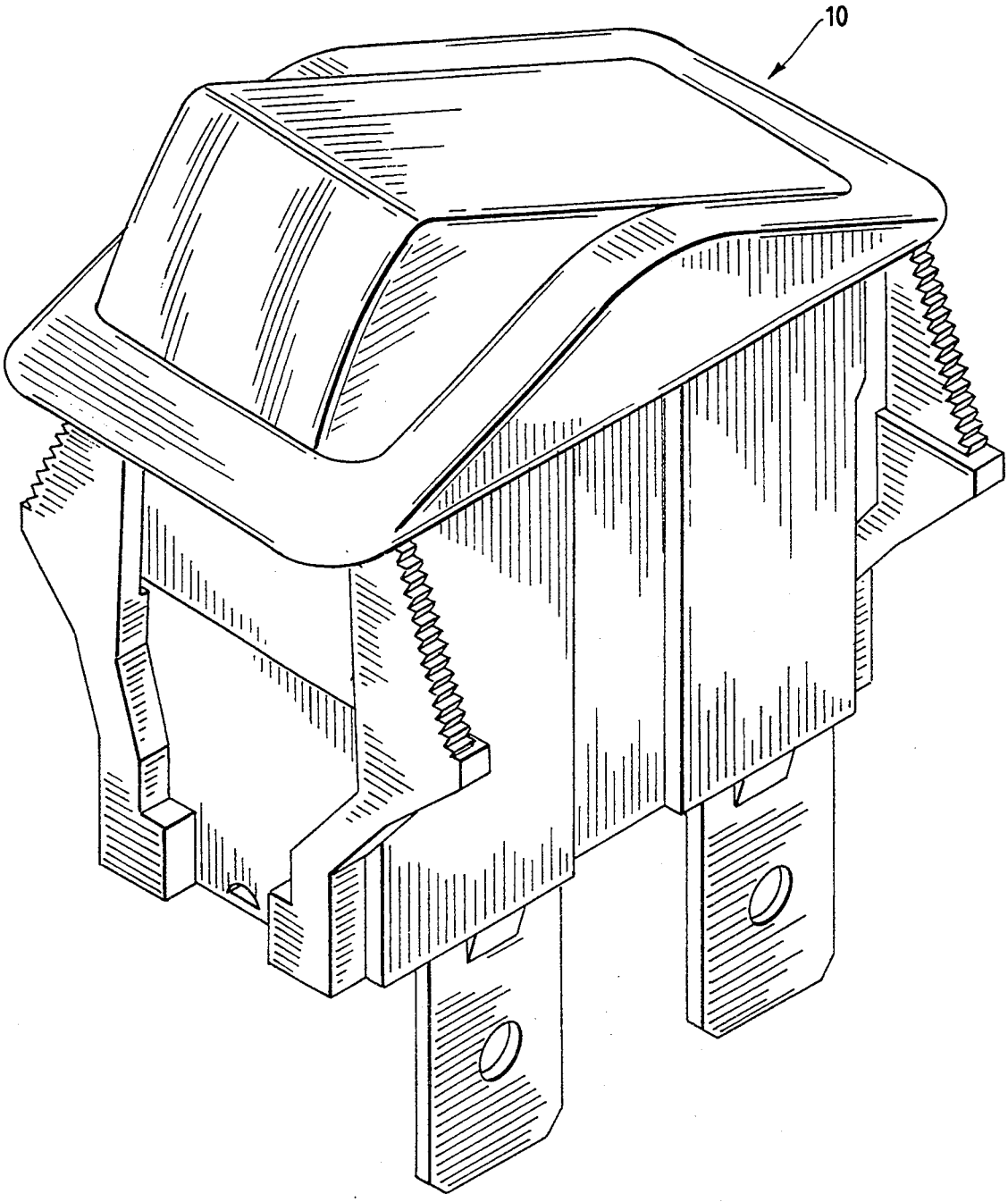
FIG. 1 is a perspective view of a sealed rocker switch of the type shown in FIGS. 1*a*–23, as described below.
Figure 1A:
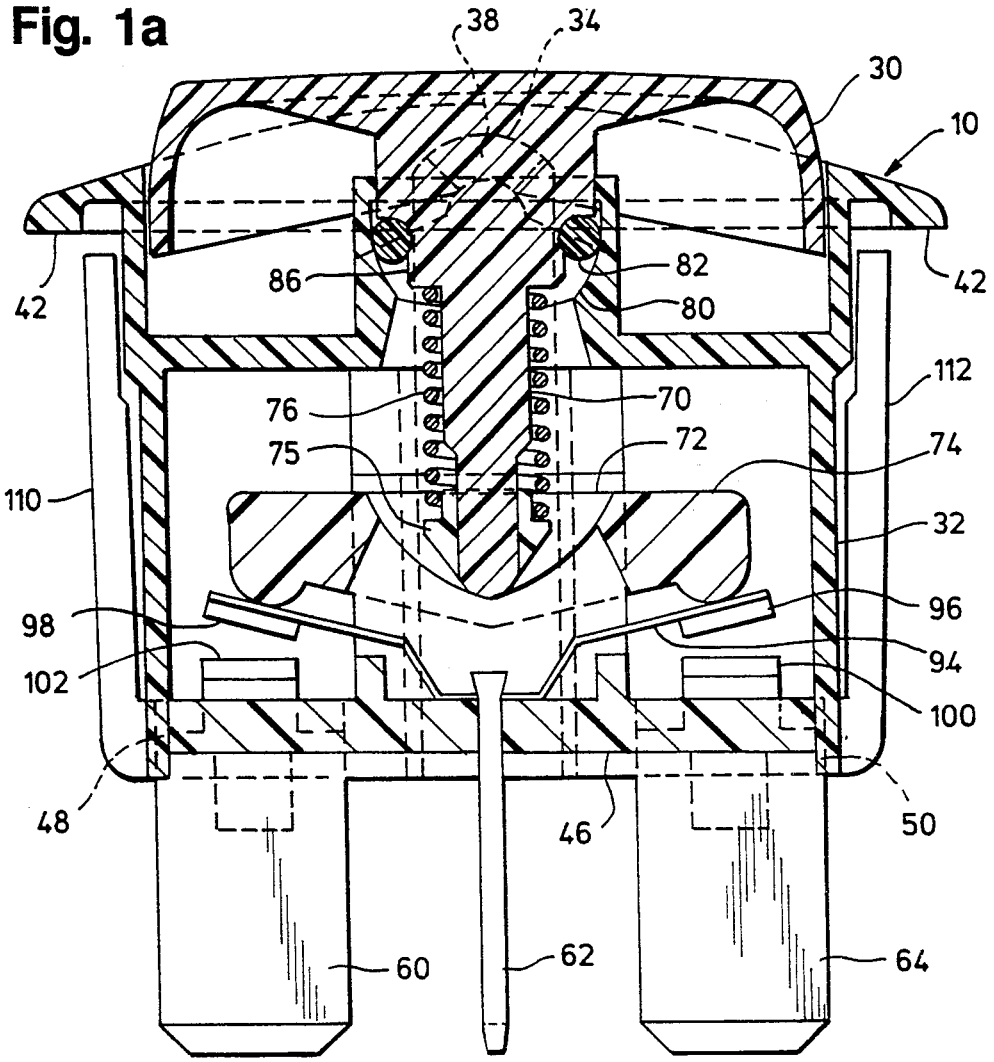
FIG. 1*a* is a central sectional side view of a sealed rocker switch for the practice of the present invention.
Figure 1C:
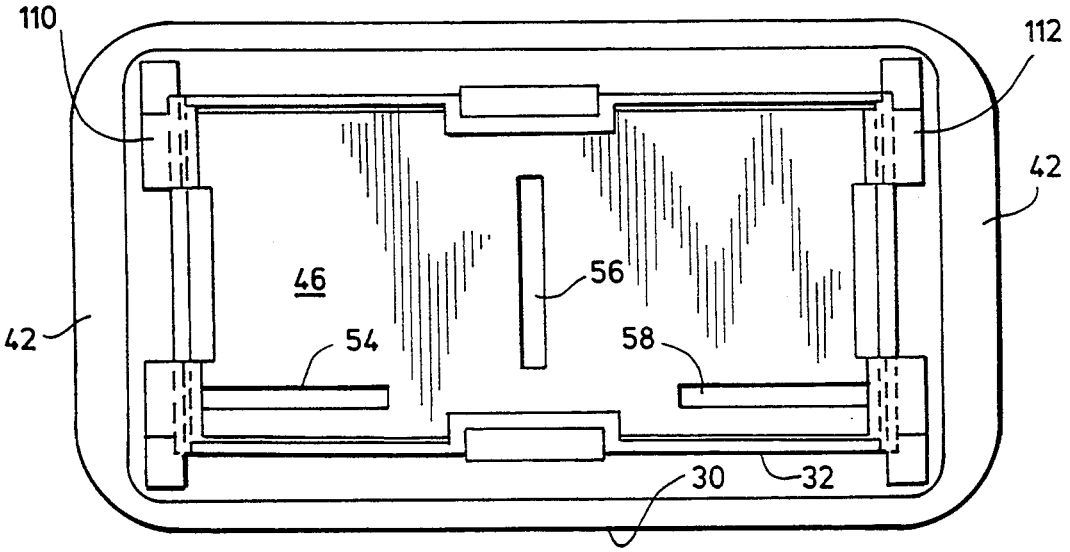
FIG. 1*c* is a bottom view of the sealed rocker switch of FIG. 1*a*.
Figure 1B:
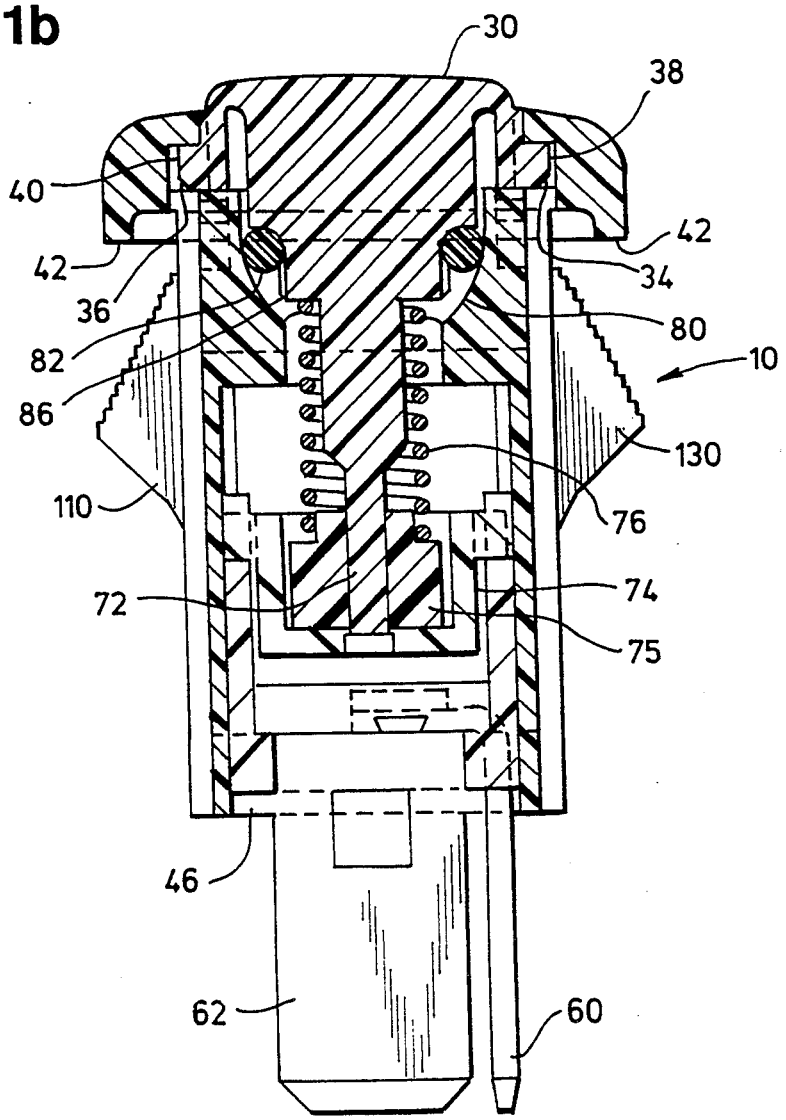
FIG. 1*b* is a central sectional end view of the sealed rocker switch of FIG. 1*a*.

Referring now to the drawings, and in particular FIG. 1–1*c* a sealed rocker switch 10 for practice of the present invention is described. FIG. 1 is a perspective view of a sealed rocker switch of the type shown in FIGS. 1*a*–23. FIG. 1*a* is a central sectional side view of a sealed rocker switch for the practice of the present invention and FIG. 1*b* is a central sectional end view of the sealed rocker switch 10. The rocker switch 10 includes a button 30 which snaps into a case 32 and rotates a predetermined amount with respect to the case 32 about a pair of pivots 34 and 36. The button 30 is inserted into the case 32 by pressing the sidewalls of the button 30 together enough to withdraw a pair of projections 38 and 40 to let the button 30 snap into place. The projections 38 and 40 engage the case 30, keeping the button 30 in place and providing support for the button 30 to rock on the pivots 34 and 36. An escutcheon 42 that is part of the case 32 projects around the case 32 to cover any panel opening into which the switch 10 of the present invention is inserted, and also serves as a positioning stop for the switch 10.

Figure 2:
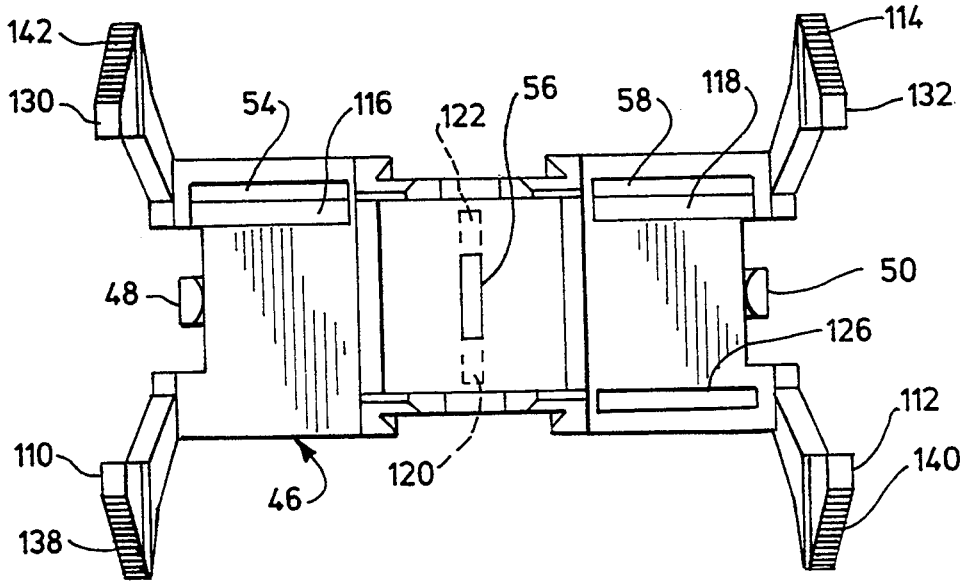
FIG. 2 is a top view of the switch base of FIGS. 1*a* and 1*b*.
Figure 3:
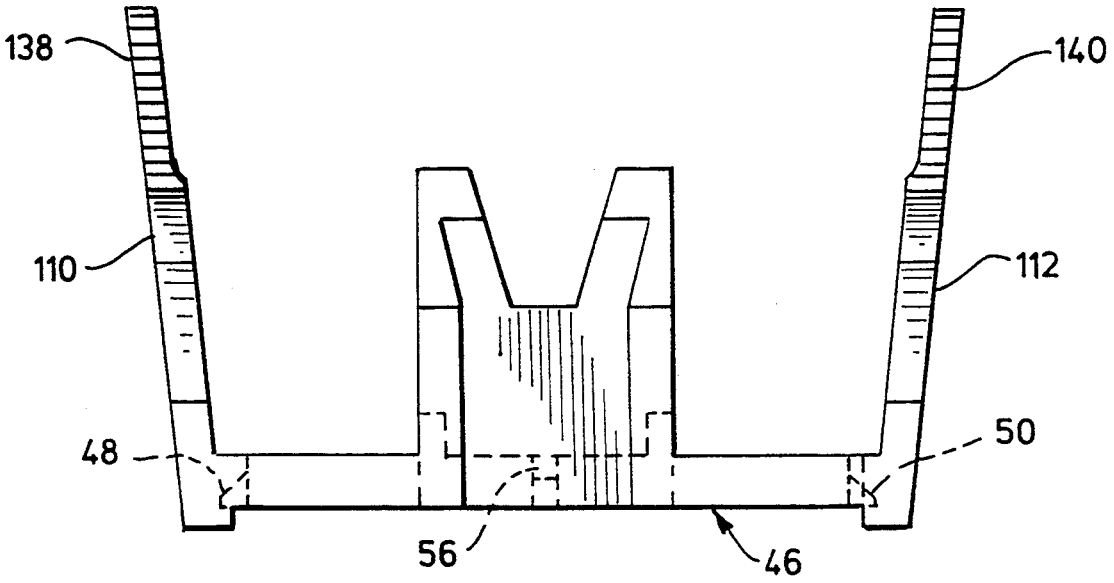
FIG. 3 is a sectional side view of the switch base of FIGS. 1*a* and 1*b*.
Figure 4:
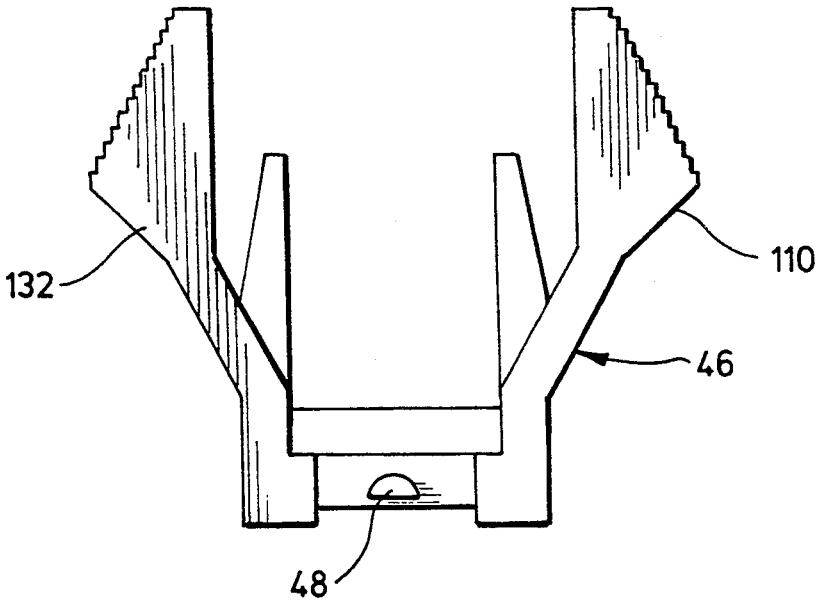
FIG. 4 is an end view of the switch base of FIGS. 1*a* and 1*b*.

A base 46 snaps into the case 32, where it is retained by a pair of projections 48 and 50 which lock respective openings 152, 154 in the case 32. The projections 48, 50 are best seen in FIGS. 2–4. The base 46 has a plurality of openings 54, 56, and 58. In the embodiment of the invention that has been built and tested, the openings 54, 56, and 58 were shaped to fit a first blade contact 60, a center blade contact 62 and a second blade contact 64, respectively. The blade contacts 60–64 extend through the base 46 and are secured to the base 46 by means that will be shown later. If it had been desired to configure the switch 10 of FIGS. 1*a*, 1*b*, and 1*c* as a single-pole, single-throw switch, one of the openings 54 or 58 would have been omitted. It would also have been possible to add another opening corresponding to the openings 54 or 58 to provide an external source of power for independent control of a light bulb (not shown). All of these openings are sealed around the blade contacts 60, 62, and 64 (and others if they are used) by a conventional potting compound that keeps dust and water out of that end of the switch 10. The case 32 projects beyond the base 46 by an amount that is sufficient to serve as a potting dam.

A spherical portion 86 of the lever 70 is held against a partially spherical surface 80 in the case 32. A groove in the lever 70 supports an O-ring against the case 32 to seal the switch 10 at the button end. The O-ring 82 maintains a seal against dust and moisture. The spherical surface 80 is both part of the seal formed by the O-ring 82 and also permits rotational motion of the button 30. A coil spring 76 coaxial with the lever 70 and enclosing a portion of the lever 70 forces a plunger 75 against an actuator 74. The plunger 75 is mounted to slide on a cylindrical end 72 of the lever 70 and move the actuator 74. The actuator 74 rocks to place a spring blade 94 in contact with the first and second blade contacts 60, 64 to operate the switch 10. More specifically, the actuator 74 moves the spring blade 94 to make and break electrical contact between the first and second blade contacts 60, 64 and the center blade contact 62. The plunger 75 is constrained by the lever and actuator 74 planar motion, which causes the lever 70 to rotate substantially in a plane.

FIG. 2 is a top view of the switch base 46 of FIGS. 1*a*, 1*b*, and 1*c*, FIG. 3 is a sectional side view of the switch base 46 of FIGS. 1*a* and 1*b*, and FIG. 4 is an end view of the switch base 46 of FIGS. 1*a* and 1*b*. In FIGS. 2, 3, and 4 the projections 48 and 50 are seen in more detail. The terminal slots 54 and 58 are seen to have a corresponding pair of bending chamfers 116 and 118, relieved to clear a bending radius created in forming the first and second blade contacts 60, 64. The terminal slot 56 includes shoulders 120 and 122, each of which serves as a stop to limit insertion of the center blade contact 62 to a desired depth. FIG. 2 also shows a terminal slot 126 which can be used to insert a blade contact to bring power to a light bulb in the switch 10 of the present invention.

The views of FIGS. 2 and 4 show dimensions and terminal layouts that are appropriate for a single-pole switch. It should be evident that if it were desired to convert the base 46 of FIGS. 2 and 4 to serve a double-pole switch, it would be necessary to widen the base 46 enough to allow a second terminal slot 56 in line with the first, so that a second blade contact 62 could be inserted. All other details of construction would be the same of substantially the same as for a single-pole switch.

The assembled switch 10 will be held in a slot in a panel (not shown) by the retention wings 110, 112, 130, 132. The retention wings 110, 112, 130, 132 include respective serrated edges 138, 140, 142, 144 which grip the inside edge of the panel to support the switch 10. To insert a switch in a panel, the retention wing 110 is pressed toward the retention wing 130 and the retention wing 112 is pressed toward the retention wing 132. Each retention wing is pressed in an amount sufficient to let the switch 10 snap into the slot in the panel. The retention wings 110, 112, 130, 132 spread along the edge of the panel slot so that the escutcheon 42 of FIGS. 1*a*–1*c* abuts at the surface of the panel to which the switch 10 is being mounted.

Figure 6:
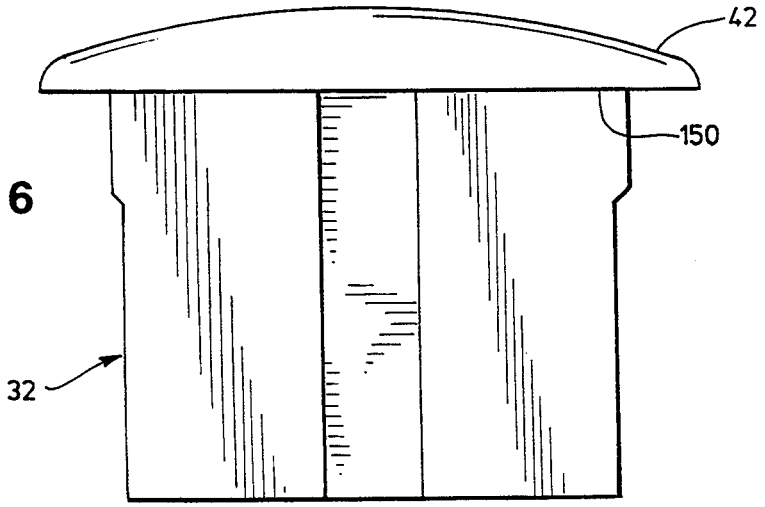
FIG. 6 is a side view of the switch case of FIGS. 1*a* and 1*b*.
Figure 7:
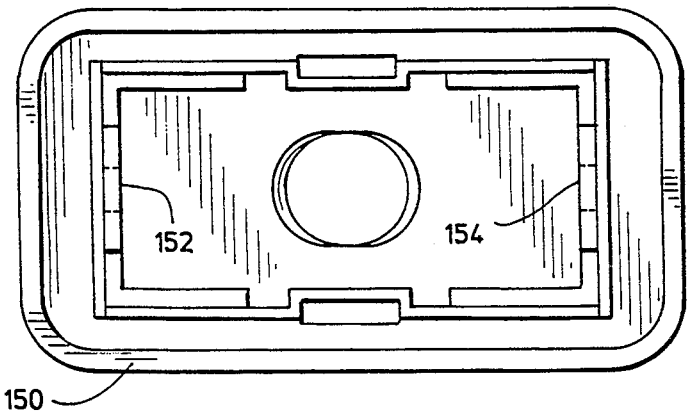
FIG. 7 is a bottom end view of the switch case of FIGS. 1*a* and 1*b*.
Figure 8:
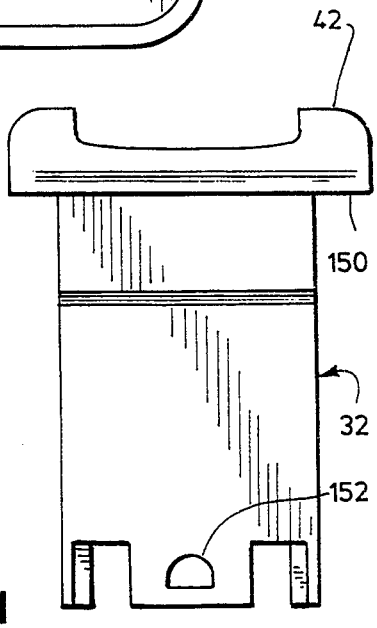
FIG. 8 is an end view of the switch case of FIG. 7.
Figure 5:
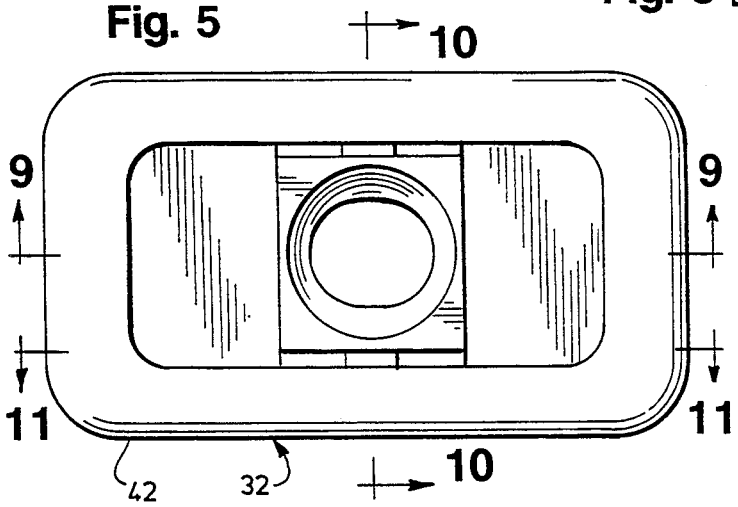
FIG. 5 is a top view of the switch case of FIGS. 1*a* and 1*b*.
Figure 9:
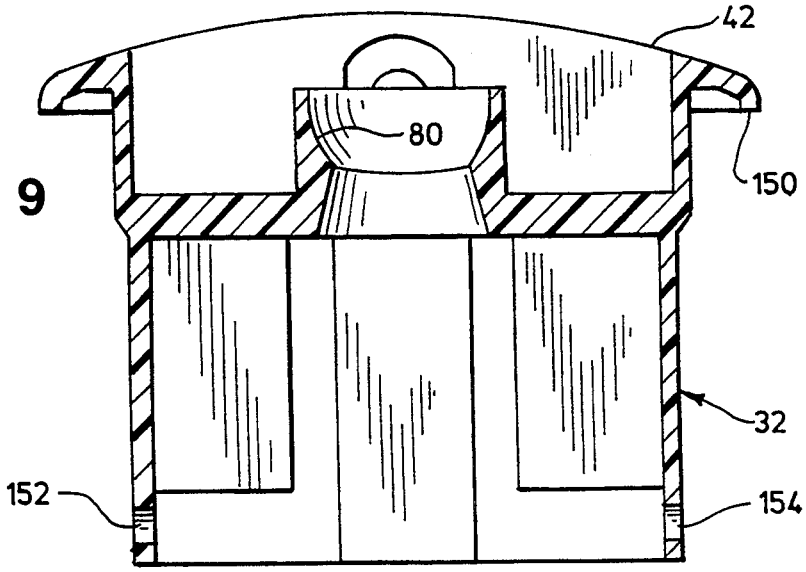
FIG. 9 is a sectional side view of the switch case of FIG. 8.
Figure 10:
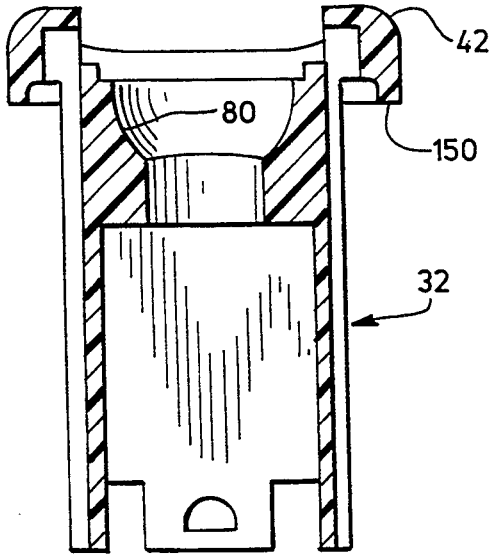
FIG. 10 is a sectional end view of the switch case of FIG. 8.
Figure 11:
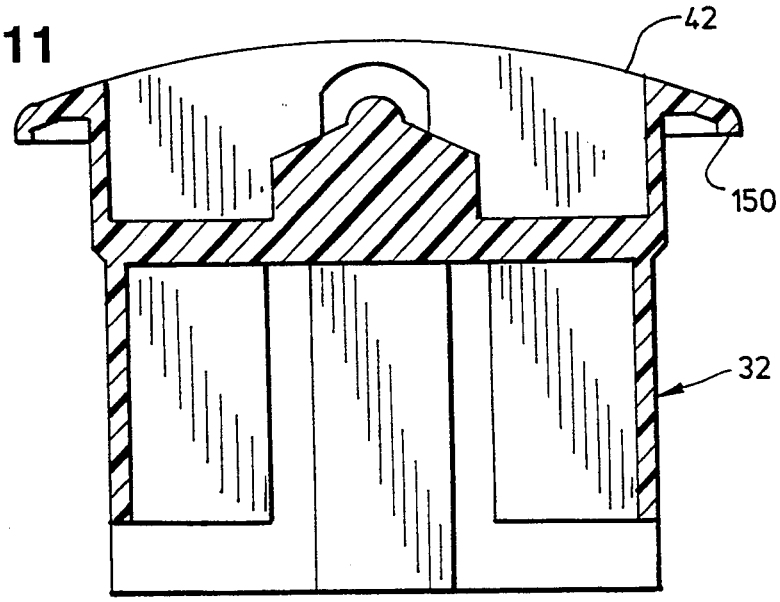
FIG. 11 is a sectional end view of the switch case of FIG. 8, taken at the pivot.

FIG. 5 is a top view of the switch case 32 of FIGS. 1*a* and 1*b*, FIG. 6 is a side view of the switch case 32 of FIGS. 1*a* and 1*b*, FIG. 7 is a bottom end view of the switch case 32 of FIGS. 1*a* and 1*b*, FIG. 8 is an end view of the switch case 32 of FIG. 7, FIG. 9 is a sectional side view of the switch case 32 of FIG. 8, FIG. 10 is sectional end view of the switch case 32, and FIG. 11 is a sectional end view of the switch case 32 of FIG. 8, taken at the pivot between the switch case 32 and the button 30. As can be seen in FIGS. 5–11, the escutcheon 42 of the case 32 includes a flat surface 150 that supports the switch 10 against the edges of a panel cutout. A pair of openings 152 and 154 are provided to lock the base 46 in place by means of the projections 48 and 50. The spherical surface 80 is both part of a seal formed by the O-ring 82 of FIGS. 1*a*–1*c* and also permits rotational motion of the button 30 of FIGS. 1*a*–1*c*.

FIG. 12 is a top view of the button of FIG. 1*a* and 1*b*, FIG. 13 is a side view of the button of FIGS. 1*a* and 1*b*, FIG. 14 is an end view of the button of FIGS. 1*a* and 1*b*, FIG. 15 is a central sectional side view of the button of FIG. 1*a* and 1*b*, and FIG. 16 is a central sectional end view of the button of FIGS. 1*a* and 1*b*. In FIGS. 12–16, the pivots 34 and 36 extend from the button 30 to allow the button 30 to rock and operate the switch.

FIG. 17 is a side view of one of the blade contacts 60, 64 of FIGS. 1*a* and 1*b*, FIG. 18 is an end view of the blade contact 60 of FIG. 17, and FIG. 19 is a top view of the blade contact 60 of FIG. 17. As can be seen in FIGS. 17–19, a chamfered tip 160 makes insertion into a socket easier. A stop tab 164 is punched partly out of the blade contact 60 to lock it in place in its terminal slot 54 or 58. Each blade contact 60, 64 includes a bend 166 which provides support for a respective contact 98, 100.

FIG. 20 is a side view of the center blade contact 62 of FIGS. 1*a* and 1*b* and FIG. 21 is an end view of the center blade contact 62. In FIGS. 21 and 21, a chamfered tip 160 eases insertion into a socket when the switch is installed. A staking tip 170 is to be staked or preened to support the spring blade 94 of FIGS. 1*a*–1*c*, insuring both good electrical contact and firm mechanical support of the spring blade 94.

FIG. 22 is a side view of the spring blade 94 of FIGS. 1*a* and 1*b* and FIG. 23 is a top view of the spring blade 94 of FIG. 22. As can be seen in FIGS. 22 and 23, a flat portion 180 of the spring blade 94 is staked to the base 46 through a rectangular hole 182. Double bends 184 and 186 present the contacts 96 and 98 so that they wipe the contacts 100 and 102 of FIGS. 1*a*–1*c* on make and break, thus tending to break welds and clean the contacts 96, 98, 100, 102.

The description of the invention given here and of the apparatus for practicing it is intended to illustrate the best mode known to the inventors and to enable the practice of the invention. It should be taken as illustrative and not as limiting, and the scope of protection for the invention should be limited only by the appended claims and their equivalents.

We claim:

1. A sealed electrical rocker switch adapted for installation in an aperture in a mounting panel, comprising:

a case configured to fit in the panel aperture;

a button rotatably mounted in the case and having a lever terminating in a cylindrical end;

a base adapted to snap into the case, the base having a plurality of retention wings which are normally biased outwardly from the base and are compressible to permit the switch to be inserted into the panel aperture;

a first blade contact extending through the base;

a spring blade;

a center blade contact rigidly connected to the spring blade and extending through the base;

an actuator pivotally mounted in the case and being adapted to move the spring blade into and out of contact with the first blade contact;

a plunger slidably mounted around the cylindrical end and being adapted to engage and pivot the actuator in response to rotation of the button with respect to the case; and a spring being adapted to bias the plunger against the actuator.

2. The sealed rocker switch of claim 1, wherein the retention wings each include a serrated edge adapted to grip the inside edges of the mounting panel aperture so as to support the switch.

3. The sealed rocker switch of claim 1, further including a second blade contact extending through the base; and wherein the actuator is adapted to move the spring blade into and out of contact with the first and second blade contacts.

4. A sealed rocker switch as set forth in claim 3, including an O-ring disposed between the lever and the case.

5. A sealed rocker switch as set forth in claim 4, wherein the center blade contact is staked to the spring blade.

6. The sealed rocker switch of claim 4, wherein the case extends beyond the base to form a potting dam.

7. The sealed rocker switch of claim 4, wherein the case includes an escutcheon.

8. The sealed rocker switch of claim 4, wherein: the case includes a pair of apertures; and the base includes a pair of projections adapted to snap into the apertures and lock the base to the case.

9. The sealed rocker switch of claim 4, wherein the first and second blade contacts include stop tabs.

10. An electrical switch adapted for installation in an aperture in amounting panel, comprising:

a case configured to fit in said panel aperture;

a base adapted to snap into said case, said base having a plurality of retention wings which are normally biased outwardly from said base and are compressible to permit said switch to be inserted into said panel aperture;

a first contact extending through said base;

a spring blade;

a further contact extending through said base and being electrically connected to said spring blade; and a button movably mounted in said case and being adapted to urge said spring blade into and out of contact with said first contact.

11. The electrical switch of claim 10, wherein said further contact is centrally positioned in said base.

12. The electrical switch of claim 10, wherein said further contact is rigidly connected to said spring blade.

13. The electrical switch of claim 10, wherein said button is adapted to snap into said case.

14. The electrical switch of claim 10, wherein said retention wings each include a serrated edge adapted to grip the inside edges of said mounting panel aperture so as to support said switch.

15. The electrical switch of claim 10, wherein said case includes an escutcheon.

16. The electrical switch of claim 10, further including a second contact extending through said base; and wherein said button is further adapted to move said spring blade into and out of contact with said first and second contacts.

17. The electrical switch of claim 16, wherein said first, second and further contacts comprise blade contacts.

18. The electrical switch of claim 17, wherein said first and second contacts include stop tabs adapted to lock said first and second first contacts into place in said base.

19. The electrical switch of claim 10, further including an actuator movably mounted in said case and being adapted to move said spring blade into and out of contact with said first contact in response to movement of said button relative to said case.

20. The electrical switch of claim 19, wherein said button and actuator are pivotally mounted in said case.

21. The electrical switch of claim 19, further comprising:

a lever extending from said button into said case and terminating in a distal end;

a plunger slidably mounted at said distal end of said lever and being adapted to engage and pivot said actuator in response to pivotal movement of said button with respect to said case; and means for biasing said plunger against said actuator.

22. The electrical switch as set forth in claim 21, wherein said plunger is slidably mounted around said distal end of said lever.

23. The electrical switch of claim 21, wherein said biasing means comprises a spring mounted around said lever between said button and said plunger.

* * * * *